US009371143B2

(12) United States Patent
Hefner et al.

(10) Patent No.: US 9,371,143 B2
(45) Date of Patent: Jun. 21, 2016

(54) RECTANGULAR MULTI-SUBSTRATE VERTICAL FORM, FILL, AND SEAL BAG AND METHOD AND APPARATUS FOR FORMING AND FILLING SAME

(71) Applicant: Volm Companies, Inc., Antigo, WI (US)

(72) Inventors: Corbett Hefner, Antigo, WI (US); Robert McPhail, Antigo, WI (US)

(73) Assignee: Volm Companies, Inc., Antigo, WI (US)

( * ) Notice: Subject to any disclaimer, the term of this patent is extended or adjusted under 35 U.S.C. 154(b) by 615 days.

(21) Appl. No.: 13/683,395

(22) Filed: Nov. 21, 2012

(65) Prior Publication Data

US 2015/0052857 A1 Feb. 26, 2015

(51) Int. Cl.

| | |
|---|---|
| ***B65D 30/00*** | (2006.01) |
| ***B65B 1/02*** | (2006.01) |
| ***B31B 29/00*** | (2006.01) |
| ***B65D 30/06*** | (2006.01) |
| ***B65D 30/20*** | (2006.01) |
| ***B65D 33/10*** | (2006.01) |
| *B65B 9/20* | (2012.01) |
| *B65B 9/213* | (2012.01) |
| *B65B 9/22* | (2006.01) |

(52) U.S. Cl.

CPC . *B65B 1/02* (2013.01); *B31B 29/00* (2013.01); *B65D 29/04* (2013.01); *B65D 31/10* (2013.01); *B65D 33/10* (2013.01)

(58) Field of Classification Search

USPC ..... 53/551, 451, 452, 389.2, 410; 493/267; 206/554; 383/117, 119, 102, 109, 120, 383/17; 156/209, 219, 308.4, 309.9; 428/109, 110, 35.2; 264/173.1, 284, 264/DIG. 062

See application file for complete search history.

(56) References Cited

U.S. PATENT DOCUMENTS

| | | | | |
|---|---|---|---|---|
| 4,815,253 | A * | 3/1989 | Kovacs et al. | 53/436 |
| 8,784,967 | B2 | 7/2014 | Frei et al. | |
| 8,784,969 | B2 | 7/2014 | Landertshamer | |
| 2005/0210840 | A1 * | 9/2005 | Kohl et al. | 53/551 |
| 2007/0011992 | A1 | 1/2007 | Hefner et al. | |
| 2011/0085749 | A1 * | 4/2011 | Frei et al. | 383/117 |
| 2011/0107729 | A1 * | 5/2011 | Miyazaki et al. | 53/562 |
| 2012/0008885 | A1 | 1/2012 | Karatzis | |
| 2013/0188893 | A1 | 7/2013 | Frei et al. | |
| 2013/0196098 | A1 | 8/2013 | Frei et al. | |
| 2015/0052857 | A1 | 2/2015 | Hefner et al. | |

FOREIGN PATENT DOCUMENTS

EP 1 726 530 A1 11/2006

OTHER PUBLICATIONS

Written Opinion of the International Search Authority Dated Mar. 6, 2014 for PCT/US2013/069576.

* cited by examiner

*Primary Examiner* — Hemant M Desai
*Assistant Examiner* — Valentin Neacsu
(74) *Attorney, Agent, or Firm* — Boyle Fredrickson, S.C.

(57) ABSTRACT

A VFFS bag is provided that is dimensionally stable, aesthetically pleasing, and renders items stored in it highly visible. The bag includes first and second gusseted side walls that span a depth of the bag and front and rear walls that span a width of the bag. The bag has a substantially rectangular closed bottom end. In order to maximize the viewabilty of stored items and reduce the amount of film material in the bag, the bag has a depth to width ratio of at least 1.5:1 at the bottom of the bag. Stability is enhanced by sizing the gussets such that they closely approach but do not overlap a line longitudinally bisecting the bag. A VFFS machine and its method of operation also are disclosed.

15 Claims, 11 Drawing Sheets

RECTANGULAR MULTI-SUBSTRATE VERTICAL FORM, FILL, AND SEAL BAG AND METHOD AND APPARATUS FOR FORMING AND FILLING SAME

BACKGROUND OF THE INVENTION

1. Field of the Invention

The present invention relates to bags for storing items and, more particularly, to multisubstrate vertical form, fill, and seal (VFFS) bags that are simultaneously formed and filled. The invention additionally relates to a machine and a method for forming and filling such bags.

2. Discussion of the Related Art

In order to prevent the premature spoilage of produce and other perishable items, bags storing such items often are formed at least in part of an open mesh material. The open mesh ventilates the items in the bag or allows them to "breathe," increasing the items' shelf life. The use of open mesh material in bags offers the additional advantage of rendering the stored items highly visible to potential purchasers.

The mesh material can be preformed into the shape of a bag and filled and different times and/or locations using separate forming and filling equipment. Alternatively, the bags can be formed, filled with items, and sealed simultaneously. One such type of bag is a "vertical form, fill, and seal" or "VFFS" bag that is formed and filled while a web is pulled downwardly over a hollow forming tube, then sealed from below, then filled with items, and then sealed from above. VFFS bags however, historically were formed entirely of film.

More recently, so called "half-and half" or other multisubstrate VFFS bags were introduced that are formed from a web that is part open mesh fabric and part film. Multisubstrate VFFS bags typically are generally square in shape and have both the front and rear walls formed from a strip of a film material that can be printed with indicia providing information about the items stored in the bags. These strips thus often are called "print bands." In addition to bearing indicia, the strips also add dimensional stability to the bag, permitting the bag to stand more upright. This added dimensional stability enhances the bags' aesthetic appearance and permits more bags to be placed in a given area such as on a store shelf.

Bags usually are positioned at their point of purchase with the print bands facing outward. Because these bags are generally square in shape, the items in the bags are not easily viewed by potential purchasers, particularly if they are placed closely adjacent to one another on a shelf. This reduced visibility negates or at least mitigates the "viewability" benefits of making bags from an open mesh material in the first place.

The viewability of items stored in a VFFS bag could be improved by reducing the width of the film strips at the front and rear walls of the bag. However, since the film strips typically contribute the majority of the dimensional stability to a bag, VFFS bags with narrow print bands tend to be dimensionally unstable and, thus, "slouch" rather dramatically. This slouching reduces the aesthetics of the bags and also hinders the orderly placement of bags on shelves next to one another. It also reduces the number of bags that can be placed in a given area, a major concern in grocery stores and other applications where shelf space is at a premium.

The percentage of open mesh in a bag of a given capacity, and thus its viewability, can be increased by gusseting the mesh side walls of the bag. However, the typical gusseted bag produces a "bunched" structure at the bottom of the bag that prevents the bottom of the bag from lying flat and, thus, reduces the dimensional stability of the filled bag, counteracting one of the benefits sought by adding film strips to the bag.

The need therefore has arisen to provide a partial mesh VFFS bag that is dimensionally stable, aesthetically pleasing, and enhances the viewability of items stored in the bag.

The need also has arisen to provide a method and system for producing VFFS bags having the characteristics described above.

SUMMARY OF THE INVENTION

In accordance with a first aspect of the invention, a VFFS bag is provided that is dimensionally stable, aesthetically pleasing, and renders items stored in it highly visible. The bag includes first and second side walls that span a depth of the bag. Each of the side walls is formed from an open mesh fabric and has a top edge, a bottom edge, and a pair of longitudinally opposed, vertically extending, side edges. Each of the first and second side walls also is gusseted so as to expand between first and second side edges thereof when filled with items. The bag additionally includes front and rear walls that span a width of the bag, at least one of the front and rear walls being formed at least in part from a film material and having a top edge, a bottom edge, and first and second side edges, each adjoining a respective edge of one of the first and second side walls. The bag further has a substantially rectangular closed bottom end that is formed by bonding the bottom edges of the front and rear walls together with the bottom edges of the first and second side walls being captured therebetween. The bag is generally rectangular in transverse cross section and has a depth to width ratio of at least 1.5:1 at the bottom end of the bag.

Each of the side walls of the bag may have two vertically extending gussets formed therein. Each of the gussets is located equidistantly between an edge of the associated side wall of the bag and a line that laterally bisects a horizontal area containing a bottom surface of the bag. Each gusset has an apex that approaches but does not overlap a line that longitudinally bisects the horizontal are the bag.

In accordance with another aspect of the invention, a method of making a VFFS bag is disclosed. The method includes moving a web downwardly over a forming tube of a vertical form, fill, and seal (VFFS) machine, the web comprising a continuous strip of open mesh material having first and second edges and having a continuous strip of film material, the film material having a first edge bonded to the first edge of the open mesh material. The method additionally includes bonding the second edge of the film material to the second edge of the open mesh material, thereby forming a tubular sleeve, and shaping the sleeve into a generally rectangular form having first and second side walls formed of the open mesh material, a front wall, and a rear wall, at least one of which is formed at least in substantial part by the film material. The first and second side walls are gusseted as a result of the shaping step. The front and rear walls are then bonded together at the bottom of the sleeve with the first and second side walls captured therebetween, thereby forming a bag having a closed bottom end.

After the bonding step, the bag can be filled with items, whereupon the first and second gusseted side walls are expanded. The front and rear walls can then be bonded together at a location above the items with the first and second side walls captured therebetween, thereby forming a closed top end of the bag and a closed bottom end of an adjacent bag.

In one embodiment, the shaping step includes guiding the sleeve past four guide pins disposed beneath a bottom surface of the forming tube to form corners of the bag, and engaging the first and second sides of the sleeve with first and second tuckers to form the gussets.

In accordance with another aspect of the invention, a VFFS machine is provided for forming bags and filling bags with items. The machine includes a forming tube, a feed assembly, a guide arrangement, first and second tuckers, and a sealer assembly. The feed assembly feeds a continuous web to the forming tube and wraps the web around the forming tube, the web having a first edge formed from an open mesh material and a second edge formed from a film material. A sealing device seals the first and second edges of the web together to form a sleeve. The guide arrangement is located beneath a bottom end of the forming tube and shapes the sleeve into a rectangular shape as the sleeve moves therepast so that the sleeve has a front wall, a back wall, and first and second opposed side walls. The tuckers are located beneath the bottom of the forming tube and are disposed opposite one another. They selectively move toward a plane axially bisecting the forming tube to gusset the opposed side walls of the sleeve. The sealer assembly is located beneath the guide arrangement and the tuckers, and seals the front and rear walls of the sleeve together with the first and second side walls captured therebetween, thereby forming a bag having a closed bottom end.

The guide arrangement may comprise four guide pins disposed beneath the bottom end of the forming tube, the guide pins forming corners of the bag. It may also include fifth and sixth guide pins disposed beneath the bottom end of the forming tube adjacent centers of the first and second side walls of the sleeve, respectively. In order to inhibit damage to the sleeve during the production process, at least the fifth and sixth guide pins may be resiliently deflectable by the sleeve.

Each of the tuckers may be generally in the shape of a sideways "n", having first and second spaced forming edges separated by a gap and located on opposite sides of the respective one of the fifth and sixth guide pins.

Various other features, embodiments and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF THE PREFERRED EMBODIMENTS

Figure 1:
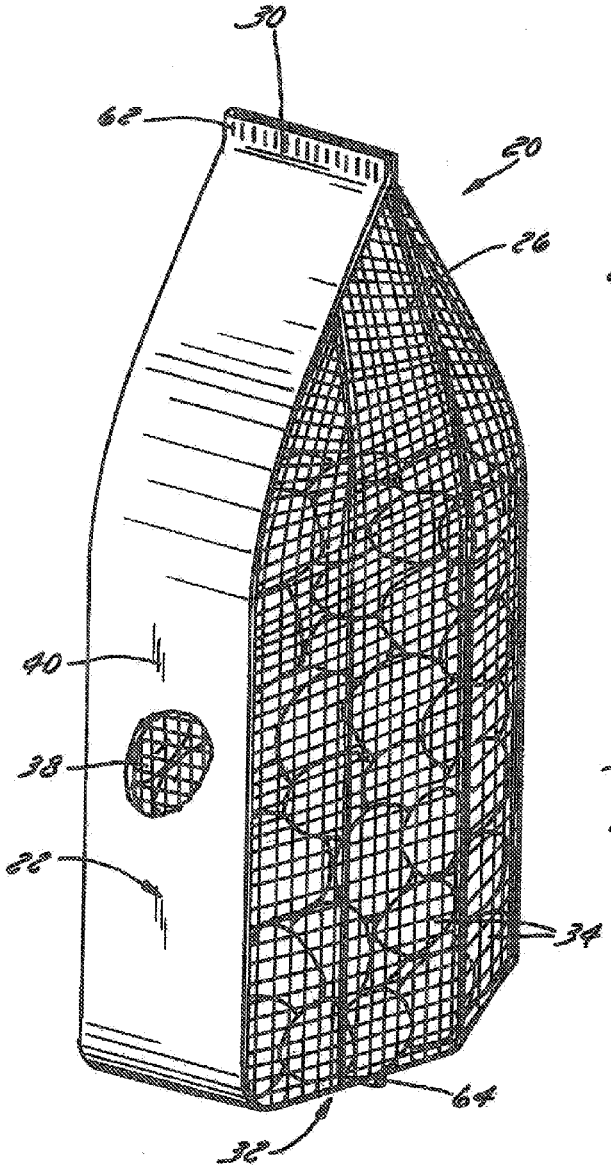
FIG. 1 is a partially cut away perspective view of rectangular VFFS bag constructed in accordance with an embodiment of the present invention, viewed from in front of and from the left side of the bag.

With regard now to the drawing figures, in which like reference numerals designate like parts throughout, a vertical form, fill, and seal (VFFS) bag 20 is illustrated in FIGS. 1-5. The bag is made from the web 100 illustrated in FIG. 6 using the VFFS machine 200 illustrated in FIGS. 8-15.

Turning first to FIGS. 1-5, the bag 20 of this embodiment comprises a so-called four-panel VFFS bag having a front wall 22, a rear wall 24, and first and second (left and right) side walls 26 and 28. The bag 20 additionally has top and bottom ends 30 and 32. The bag 20 is filled with items 34 such as produce or other food products. The term "filled" as used herein does not mean that the entire interior volume of the bag 20 must be occupied by items 34. Indeed, in commercial applications, a bag 20 typically is "filled" to its rated weight of stored items while the items occupy less than 70%, and quite often less than 50%, of the interior volume of the bag. Items that may be stored in the bag 20 may, for example, maybe nuts, oranges, potatoes, onions, seafood (such as shrimp, mussels, or clams), newspapers, flower bulbs, dried beans, or wrapped candy.

The bag 20 is generally rectangular along the majority of its length when filled with items 34, except where it is collapsed at the top end 30 where the opposed front and rear walls 22 and 24 are sealed to one another with the ends of the left and right side walls 26 and 28 captured therebetween. The left and right side walls 26 and 28 are formed from a gusseted open mesh material 38. At least the outer surface of at least one of the front and rear walls 22 and 24 is formed from a film material 40 extending lengthwise of the bag 20. Both of the front and rear walls 22 and 24 may be made at least in part from the film material 40. In the illustrated embodiment, the film material 40 extends the entire length of each of the front and rear walls 22 and 24.

Figure 2:
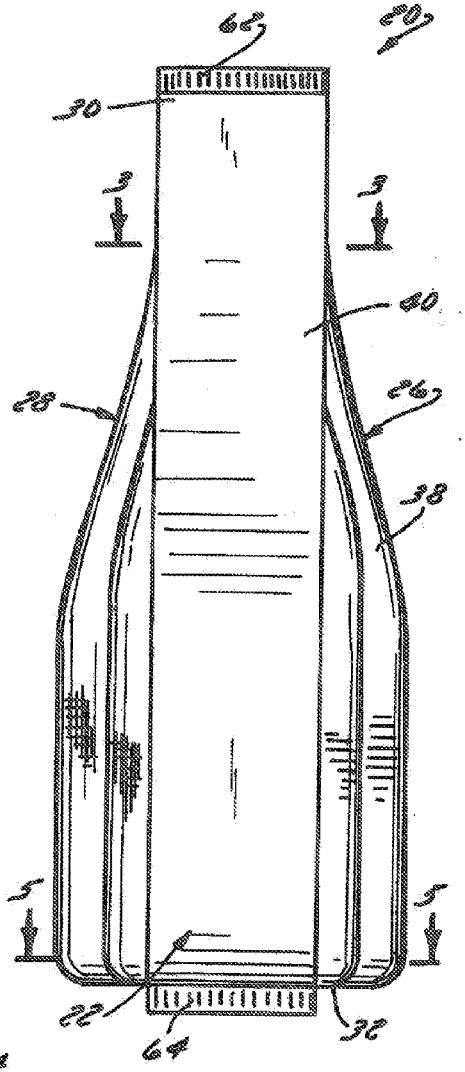
FIG. 2 is a front elevation view of the bag of FIG. 1.
Figure 4:
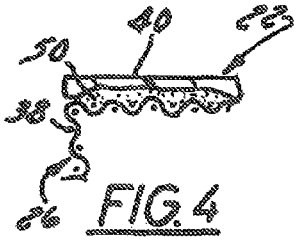
FIG. 4 is an enlarged fragmentary sectional plan view of a portion of FIG. 2, illustrating a corner of the bag.
Figure 3:
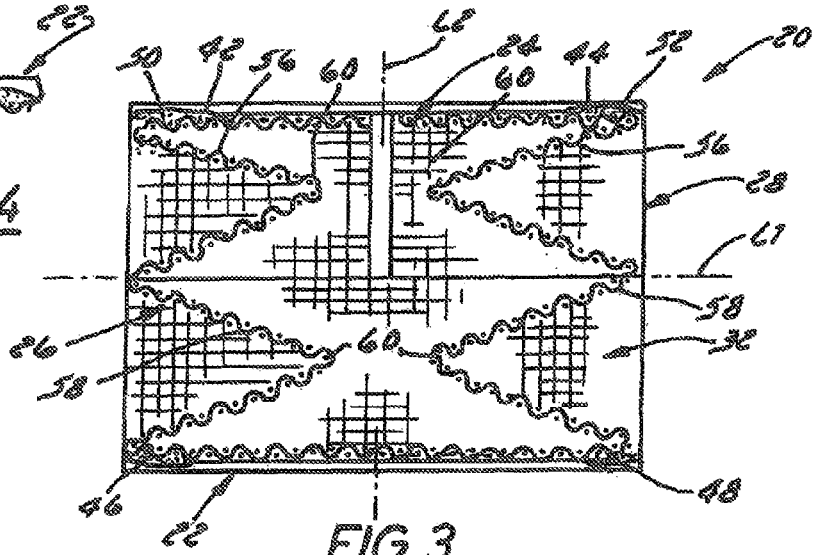
FIG. 3 is a sectional plan view taken generally along the lines 3-3 in FIG. 2.
Figure 5:
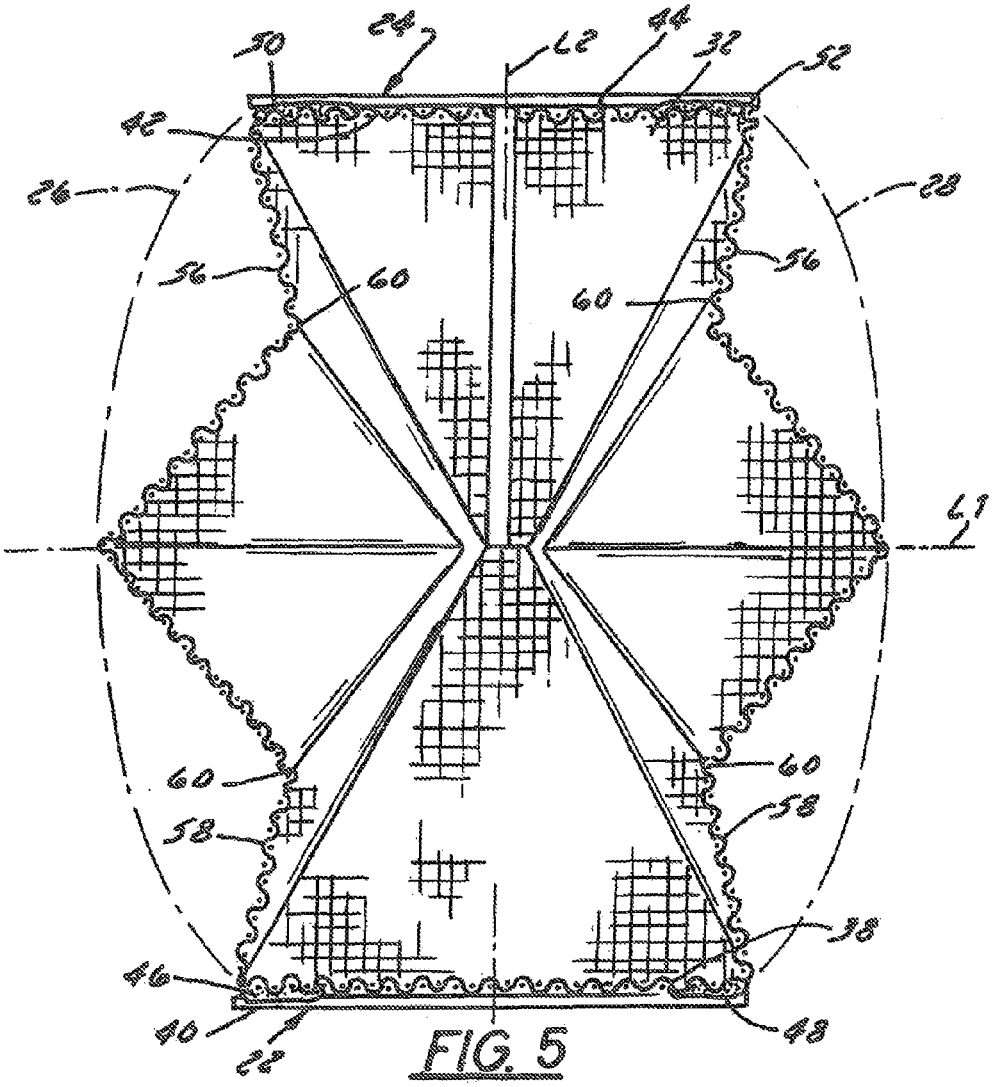
FIG. 5 is a sectional plan view taken generally along the lines 5-5 in FIG. 2.

In the bag 20 of the illustrated embodiment, the front wall 22 of the bag 20 is formed from the open mesh material 38 overlaid with the film material 40, while part of the rear wall 24 is formed solely from the film material 40. More specifically, as seen in FIGS. 3 and 5, the rear wall 24 has first and second side edge portions 42 and 44 that are formed from the open mesh material 38 and that face one another with a gap between them. A strip of the film material 40 overlies and is bonded to the edge portions 42 and 44 and bridges the gap. Referring to FIGS. 2, 4, and 5, the film material 40 preferably extends the entire width of both the front and rear walls 22 and 24, but may extend less than the entire width if desired. The strip of film material 40 forming the outer surface of the front wall 22 is heat sealed to underlying mesh fabric material 38 at its edges via seams 46, 48 that are approximately 0.64 cm (¼") to 2.54 cm (1") wide. The rear wall 24 of the bag 20 has two vertically extending seams 50, 52 at the corners thereof where the film material 40 overlaps the edges 42, 44 of the open mesh material 38. Both of the seams 50, 52 comprise overlap seams.

Referring especially to FIGS. 3 and 5, the left and right side walls 26 and 28 of the bag 20 are gusseted so as to permit them to expand and increase their capacity upon being filled. In order to increase the depth to width ratio of the bag 20, each side wall 26, 28 preferably is double gusseted so as to have first and second gussets 56, 58 positioned on opposite sides of a line "L1" that laterally bisects a horizontal are containing a bottom surface the bag 20, i.e., that runs through a vertical plane passing through the centers of the side walls 26, 28. Each gusset 56, 58 preferably is centered between the line L1 and a corresponding edge of the bag 20. Each gusset 56, 58 projects into the bag 20 to a point or apex 60. In order to maximize the depth to width ratio of the bag 20 without causing the gussets 56, 58 to overlap each other at the bottom end 32 of the bag 20 and thus reducing the bag's dimensional stability, the apex 60 of each gusset 56, 58 preferably approaches but does not overlap a line "L2" that longitudinally bisects the horizontal area containing the bottom surface of the bag 20, i.e., that passes through a vertical plane extending though the centers of the front and rear walls 22, 24. The spacing between each apex 60 and the longitudinal bisector L2 preferably comprises no more than 25%, and more preferably no more than 10%, of the width of the front wall 22. In the case of a bag having front and rear walls that are each 7.62 cm (3") wide, the spacing is no more than 1.52 cm (0.6"), and more probably no more than 0.76 cm (0.3").

The bag 20 is closed at the bottom end 32. This closure could come by way of, for example, sewing, clasping, ultrasonic welding, or adhesion. It also could come by way of thermal bonding. In the illustrated embodiment, both the top and bottom ends 30 and 32 of the bag 20 are closed by thermally bonded seams as seen in FIGS. 1 and 2. These seams may take the form of fin or peel seams 62, 64 formed by pressing two seal bars together, also as discussed below. They alternatively could be formed by other seams such as overlap seams. The upper and lower seams 62, 64 typically have a height H of about 0.95 cm (⅜") to 1.27 cm (½").

Figure 7:
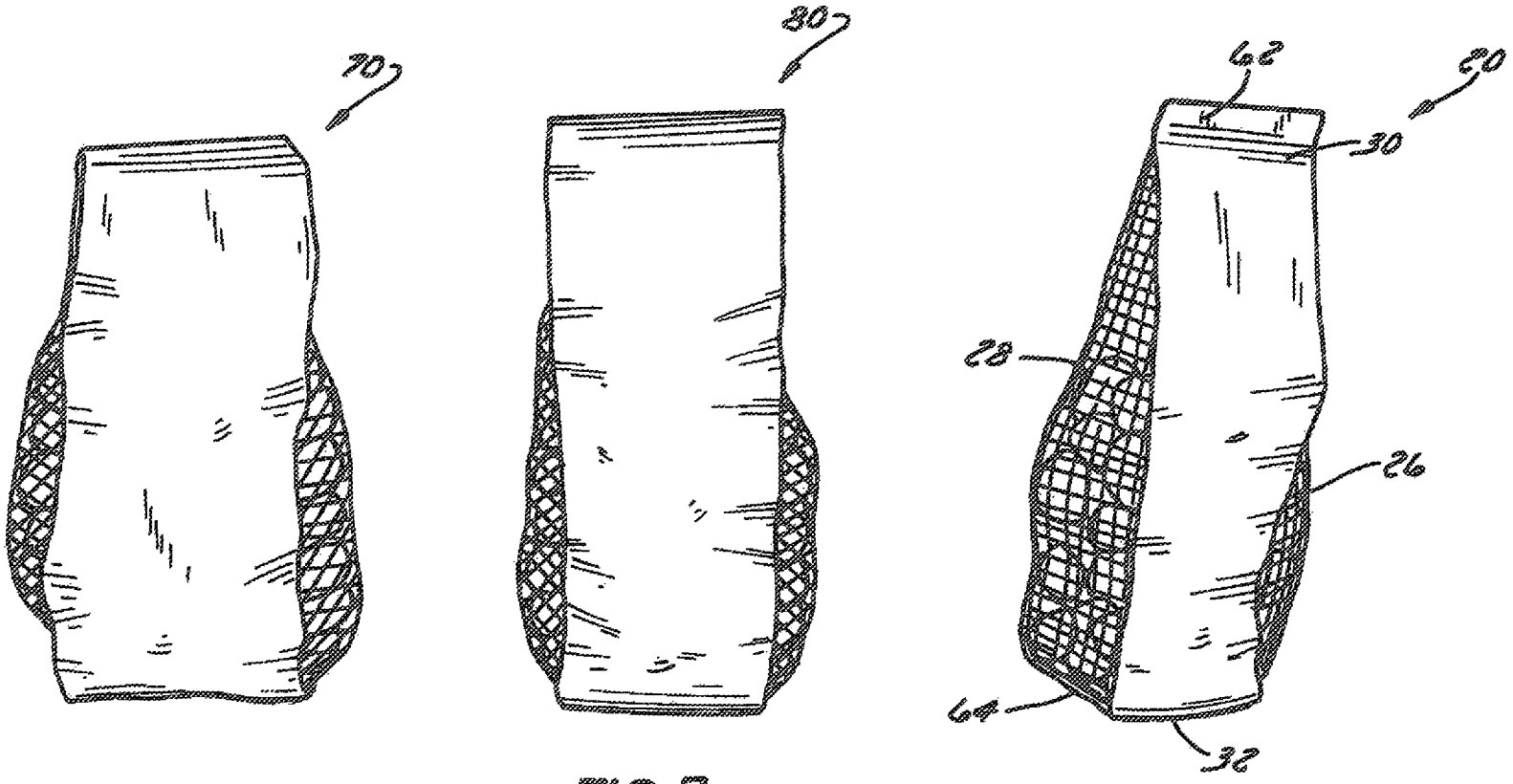
FIG. 7 is a side elevation view showing the bag of FIGS. 1-5 juxtaposed next two prior art VFFS bags.

The relationship between the gussets 56, 58 and the front and rear walls 22, 24 at the bottom 32 of the bag 20 prevents the bottom 32 of the bag 20 from bunching and, thus, provides a stable, flat surface upon which the remainder of the bag 20 can be supported as seen in FIG. 7, discussed in more detail below.

A bag 20 constructed as described thus far can have a depth to width ratio, as measured by the ratio of the length of a sidewall 26 or 28 to the length of an adjacent front or rear wall 22 or 24 at the bottom 32 of the bag 20, where the bag is not deformed by items stored therein, of over 1.5:1 and even of over 1.75:1. The bag 20 is nevertheless dimensionally very stable. The illustrated bag 20 has a width of 7.62 cm (3") and a depth of 13.34 cm (5.25"), resulting in a depth to width ratio of 1.75:1.

Referring now to FIG. 7, it can be seen that a VFFS bag 20 constructed as described thus far provides comparable or better visibility of stored items than prior art multi-substrate VFFS bags 70 and 80, yet is remarkably stable. Each of the bags 20, 70, and 80 has a depth of 13.33 cm (5.25"). Bag 70 has a width of 13.33 cm (5.25"), and bag 80 has width of 10.80 cm (4.25"). The bag 20 constructed as a described above has a width of 7.62 cm (3"). Its width thus is about 30% less than that of the bag 80 and over 40% less than that of the bag 70. Its depth to width ratio is dramatically higher than that of either bag 70 or bag 80. The bulging that naturally occurs at the sides of each of these bags 20, 70, and 80 from the pressure of the stored items, though less pronounced in the bag 20 than in the prior art bags 70 and 80, has a visually more dramatic effect due to the increased depth to width ratio of the bag 20 when compared to that of the bags 70 and 80. Yet the stability of the bag 20 is comparable to or even superior to that of the bags 70 and 80. The superior stability is particularly evident at the bottom of the bags, were the inventive bag 20 rests very flat against the surface on which it is supported, whereas the bags 70 and 80 appear comparatively "lumpy".

It should also be noted at this time that the reduced width to depth ratio of the inventive bag 20 results in substantial cost savings when compared to prior art bags. The "label stock" typically used as the film material of multi-substrate bags is relatively expensive when compared to the open mesh material. By reducing the width to depth ratio, the bag 20 has over 25% less label stock when compared to the bags 70 and 80, resulting in a considerable cost reduction.

The illustrated bag 20, having the aforementioned "footprint" of 7.62 cm×13.33 cm (3"×5.25"), has a storage capacity of three lbs and is about 38.10 cm (15") high. A bag having the same footprint and a two pound capacity would be about 30.48 cm (12") high, and a bag having the same footprint and a one-pound capacity would be about 25.40 cm (10") high. However, the concepts discussed herein are equally applicable to larger or smaller bags of different proportions.

Figure 6:
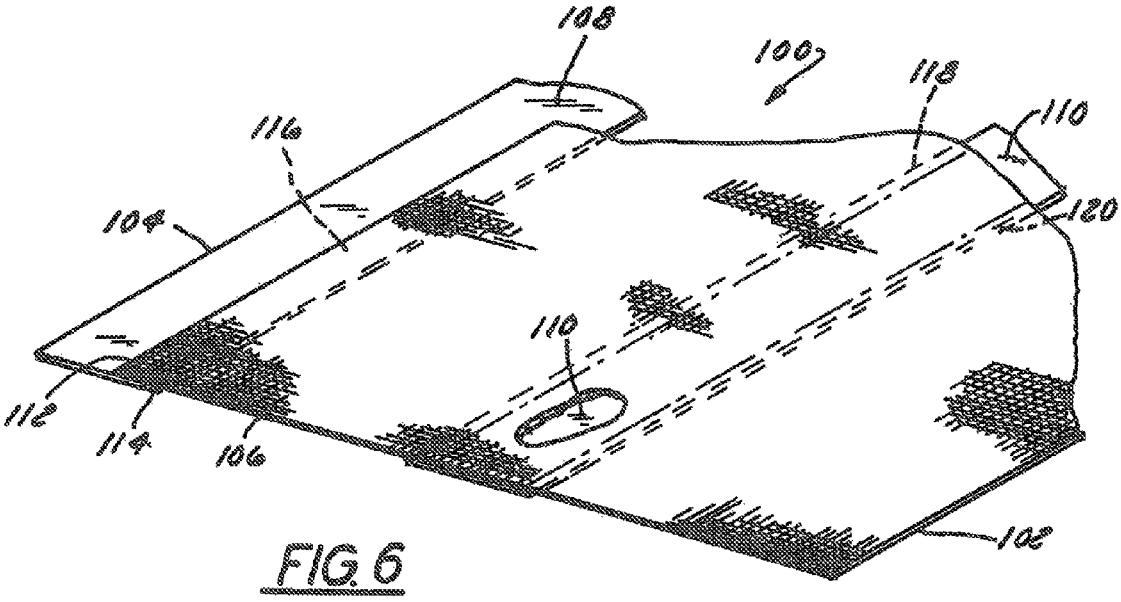
FIG. 6 is a partially cut-away perspective view of a portion of a web usable to form the bag of FIGS. 1-5.

Referring now to FIG. 6, a web 100 is illustrated from which bag 20 can be made. Web 100 is formed from strips of the open mesh material 38 and the film material 40 and has first and second opposed edges 102, 104. A single seamless strip 106 of open mesh material 38 is provided in this embodiment and is preferred for both strength and aesthetics, but two or more such strips could be bonded together, if desired. First and second strips 108, 110 of film material 40 are provided in this embodiment. The first strip 108 will ultimately form the outer portion of the rear walls 24 of the bags 20, and the second strip 110 will ultimately form the outer portion of the front walls 22 of the bags 20. In the illustrated embodiment in which each finished bag 20 will have a footprint of 7.62 cm×13.33 cm (3"×5.25"), the web 100 has a width of 41.61 cm (16⅜") to 45.40 cm (17.875"). The mesh strip 106 is about 39.37 cm to 41.9 cm (15.5" to 16.5") wide, and each film strip 108, 110 is about 7.62 cm (3") wide. The strips 106, 108, 110 may be bonded together by the VFFS machine 200 as described below or may be bonded together by a different machine and supplied to the VFFS machine 200 as a preformed web.

The mesh strip 106 has a first or outer edge forming the first edge 102 of the web 100 and a second edge 112 that is thermally bonded to a first edge 114 of the first film strip 108. The first film strip 108 also has a second edge forming the second edge 104 of the web 100. The mesh strip 106 and film strip 108 overlap one another to form a seam 116. The width "D" of the seam preferably is set to provide adequate strength to the bond between the strips 106 and 108 such that the web 100 can function adequately when formed into a bag for storing produce or other items. By securing the mesh strip 106 to the film strip 108 in this configuration, the strength of the bond between the mesh strip 106 and film strip 108 is further enhanced regardless of the amount of overlap due to the integral form of the seal at the seam 116. This is because the film strip 108 is softened upon heating to the point where the film strip 108 can surround the overlapped portion of the mesh strip 106. When cooled, the mesh strip 106 is contained at least partially within the film strip 108 to form a unitary structure for the seam 116. The width "D" of the overlap can be varied between 0.32 cm and 1.27 cm (⅛" and ½"), depending, for example, upon the particular use to which the web 100 will be put.

Still referring to FIG. 6, the second film strip 110 is bonded to the mesh strip 106 midway between the first and second edges 102 and 104 of the web 100. This bond may occur across any desired portion(s) of the width of the second film strip 110, and preferably is performed at edge seams 118, 120 that are between 0.32 cm and 1.27 cm (⅛" and ½") wide.

Both of the film strips 108 and 110 may be formed of the same film material 40. The material may be any film material capable of being heat bonded to itself and to other materials. It preferably is capable of receiving indicia on its inner and/or outer layer(s) and thus as functioning as a print band. A material made in whole or in part from a synthetic resin film material could suffice. One such material, available from the Volm Companies of Antigo Wis., is a so-called PET laminate having a thin layer of a relatively high melting point polyester material, serving as a print surface, laminated onto a relatively thick layer of a relatively low melting point linear low density polyethylene (LLDPE) material. The LLDPE material melts during the heat bonding process to seal the film material to adjacent materials.

The open mesh material 38 may be any open mesh material to which a thermoplastic film strip can be heat bonded to form a seam that is sufficiently strong for use as form, fill, and seal bags. Preferably, the open mesh material 38 also is suitable for processing into bags using high speed bag-making equipment. Woven, knit, scrim, aperated, and extruded net materials are suitable for this purpose and nonwoven fabrics can be used provided they have sufficient openness of construction to allow adequate visibility of a bag's contents. Suitable woven, knit, or scrim fabrics may be formed from tapes or slit-film ribbon yams. The yarns of the fabric or such yarns and any coatings will generally comprise a thermoplastic resin composition.

It also is contemplated to form the open mesh material 38 from thermoplastic resin compositions having different melting points, with a higher melting resin being present to provide strength and integrity to the fabric and a lower melting resin being present, either as a discontinuous coating on the surface of the fabric or laminated to or as part of the yarns thereof, e.g., as coextruded tapes, to provide for heat bonding of the yarns of the fabric to one another and, in turn, greater dimensional stability and resistance to fraying. One such material is formed from a number of intersecting filaments, at least some of which are composite filaments formed from a composite material having a high melting point "carrier" portion and a relatively low melting point "bonding" portion. This material is commercially available from the Volm Companies Inc. of Antigo, Wis. under the brand name ULTRATECH®. Permutations of this material are described in U.S. Pat. Pub. No. 2011/0085749, the contents of which are incorporated by reference. Another suitable material is a nonwoven fabric made from coextruded film that has been split and stretched. This material is commercially available from JX Nippon ANCI, Inc. under the brand name CLAF®. CLAF® material and its characteristics are described in more detail, e.g, in U.S. Pat. Nos. 4,929,303 and 5,182,162, the contents of which are hereby incorporated by reference.

Preferably, the melting point of the film material 40 is at least about 10° C. below the melting point of the open mesh material 38 to facilitate heat sealing without melting or softening of the mesh material 38. More preferably, the melting point differential is about 30° C. to about 60° C. The resin of the film strips 108, 110 should also provide sufficient seal strength and adhesion so that the bags hold product without breaking or failure at or adjacent to the seams during filling, handling, and use. Preferably, the open mesh material 38 and film material 40 are composed of resins and so configured as to provide longitudinal seams having a strength of at least about 35.5 kPa (5 lb/in$^2$) as measured by ASTM D 5035-95. More preferably, seam strength is at least about 55.2 kPa (8 lb/in$^2$).

Figure 8:
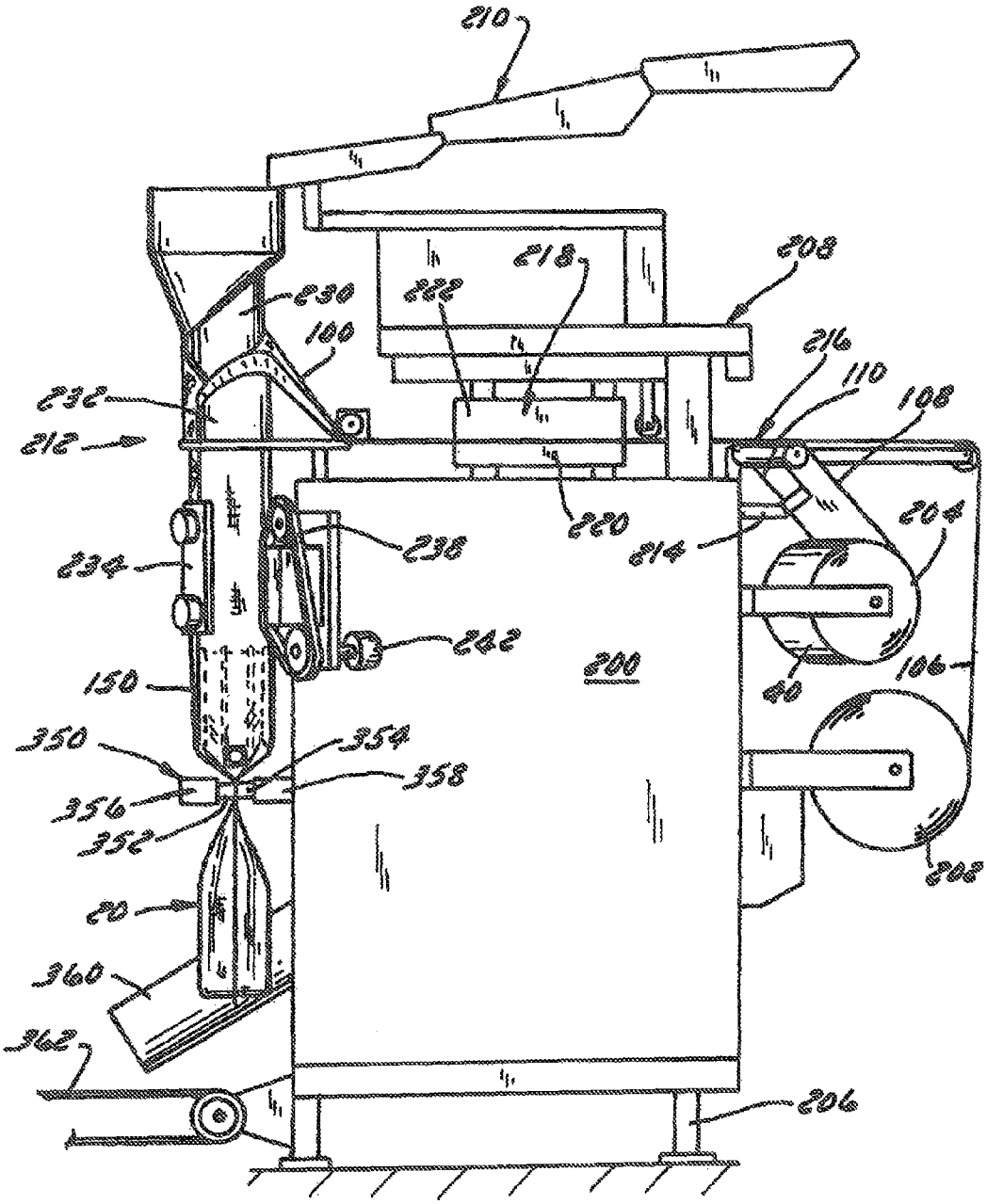
FIG. 8 is a somewhat schematic side elevation view of a VFFS machine that can be used to make the bag of FIGS. 1-5.
Figure 9:
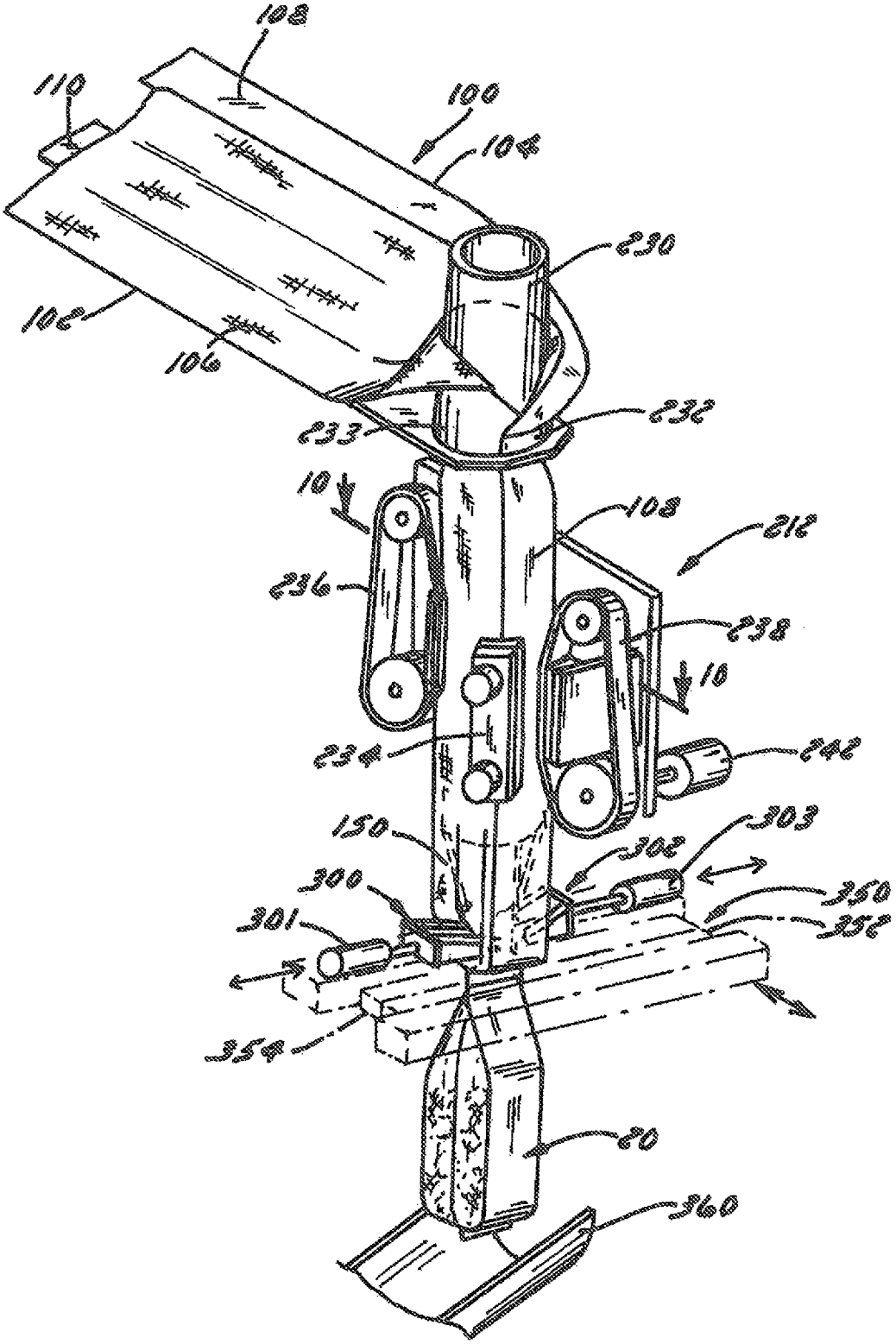
FIG. 9 is a perspective view showing a portion of the VFFS machine of FIG. 8 in greater detail.

Turning now to FIGS. 8-15 and initially to FIGS. 8 and 9, the bags 20 may be manufactured on a vertical form, fill, and seal machine 200 that forms the web 100 from rolls 202 and 204 of the open mesh material 38 and the film material 40, respectively, and that forms and fills bags 20 from the web 100. The machine 200 includes a frame 206, a web forming station 208, a product dispenser 210, and a form, fill, and seal assembly 212. The web forming station 208 forms a continuous strip of the afore-described web 100 from rolls 202 and 204 of mesh and film 38, 40, respectively. The form, fill, and seal assembly 212 receives batches of items from the product dispenser 210 and simultaneously forms bags 20 from the web 100, fills those bags 20 with items, and seals the ends of the formed and filled bags 20.

Still referring to FIG. 8, the web forming station 208 includes first and second takeoff rolls 202 and 204 for the open mesh material 38 and the film material 40, respectively. The open mesh material 38 preferably is wound onto the roll 202 in a continuous strip. If the fabric is ULTRATECH® or another material with warp and weft filaments, it is preferably wound onto the roll 202 with the warp filaments extending lengthwise of the strip or in the machine direction. The warp filaments may ultimately extend vertically in the finished bags. The second takeoff roll 204 may support a roll of a PET laminated film material 40, printed with two adjacent repeating patterns of print indicia positioned side-by-side in alignment with each other. A slitter 214 is provided downstream of the takeoff roll 204 and is operable to slit the film material 40 into two indicia-bearing strips or print bands 108, 110. A system 216 of guide rollers and guide bars guides the film strips 108 and 110 and the continuous strip 106 of the open mesh material 38 into a substrate forming assembly 218, where the edge of the first film strip 108 is thermally bonded to an edge of the mesh strip 106 (FIG. 6), and the other film strip 110 is thermally bonded to the outer surface of the mesh strip 106 in a spaced apart relationship to the first film strip 108. As discussed above, segments of the film strips 108 and 110 ultimately form the rear and the front walls of the finished bags, respectively. The thermal bonding preferably is performed via a system of heated bars 220 and a platen 222 as is generally known in the art. A suitable system for slitting indicia-bearing film into two print bands and for heat bonding the print bands to a substrate is known, for example, from International Publication No. WO 99/58323 to Winiecke, the subject matter of which is hereby incorporated by reference.

As noted above, the web 100 need not be formed on the vertical form, fill, and seal machine 200. It could instead be formed by separate converting equipment located either at the same location as the vertical form, fill, and seal machine 200 or at another location entirely. Optionally forming the web 100 at a remote location would offer the bag manufacturer the option of not having to purchase and handle multiple rolls of different types of materials. It also would reduce the capital expense associated with the purchase and operation of the VFFS machine 200 because the machine would not require a web forming station.

Referring again to FIG. 8, the product dispenser 210 may function to dispense batches of items that have been weighed by a computer-weighing apparatus (not shown) at the proper time in the operating cycle of the machine 200. Suitable computer-weighing apparatuses that can perform this function are shown in U.S. Pat. Nos. 4,538,693 and 4,901,807, which are incorporated herein by reference.

Figure 10:
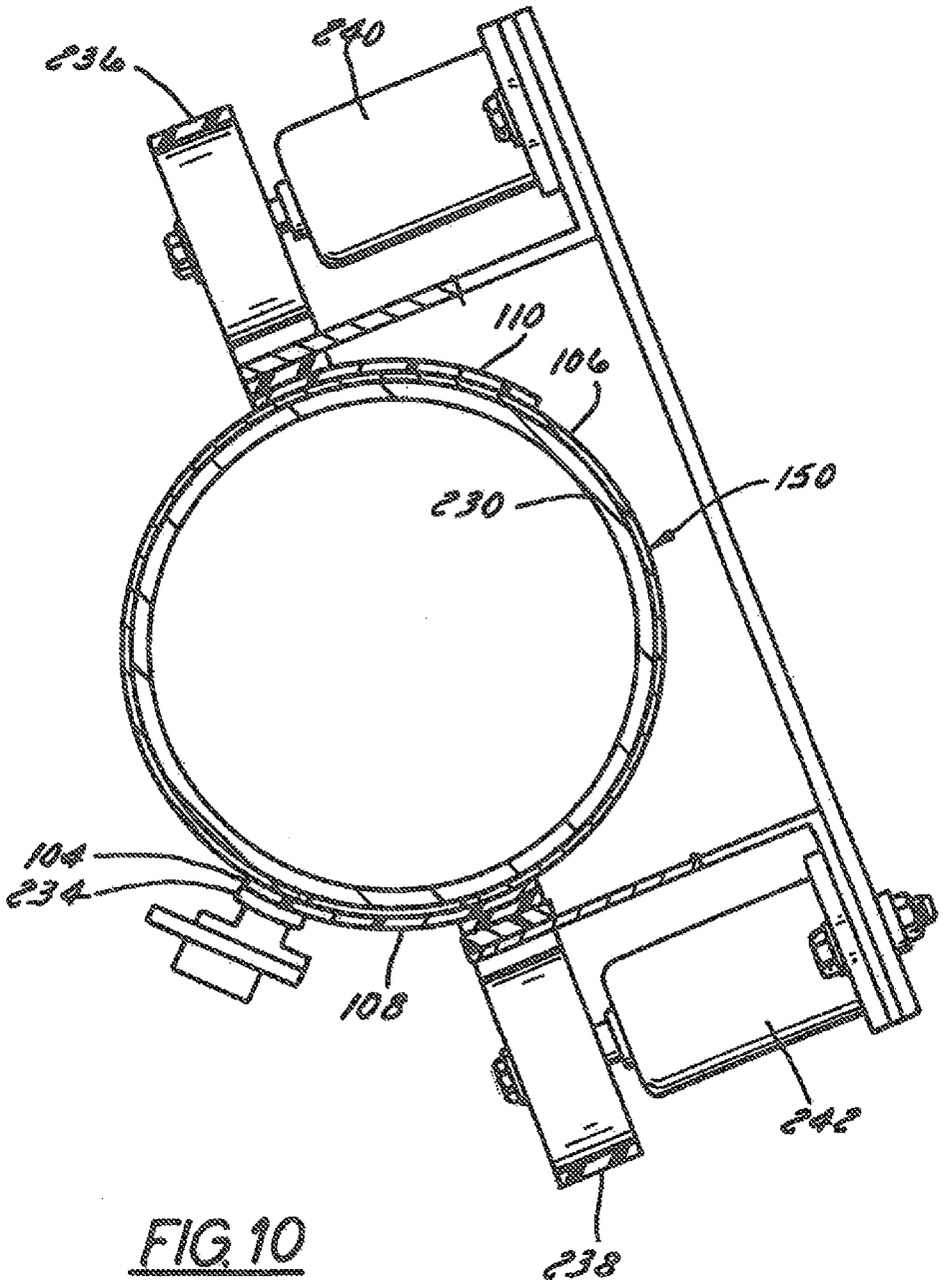
FIG. 10 is sectional plan view taken generally along the lines 10-10 in FIG. 9.

Referring to FIGS. 8-10, the form, fill, and seal assembly 212 includes a vertical forming tube 230 mounted on the frame 206 immediately below the product dispenser 210, such that items dispensed from the product dispenser 210 are received internally of the vertical forming tube 230. A forming shoulder 232 is secured to the frame 206 adjacent but spaced from an upper end of the vertical forming tube 230. A forming shoulder 232 directs the web 100 around the forming tube 230 to form an initially circular tubular sleeve 150 in which, referring briefly to FIG. 6, the outer edge 104 of the first film strip 108 of the web 100 overlaps the outer surface of the opposed edge 102 of the mesh strip 106. A vertical seal bar 234 is supported adjacent the forming tube 230. The vertical seal bar 234 heat bonds the overlapped edge of the first film strip 108 to the outer edge of the mesh strip 110 at what will ultimately be the corner of the front of the finished bag 20 to form a vertical overlap seam, hence forming the generally tubular sleeve 150. A pair of advancing belts 236, 238 is located on opposite sides of the vertical forming tube 230. Belts 236 and 238 are periodically driven by synchronized motors 240, 242 (FIG. 10) to index the sleeve 150 downwardly along the forming tube 230 the length of one bag 20 and to advance a corresponding amount of the web 100 into contact with the forming shoulder 232 to enable another bag 20 to be formed.

Figure 11:
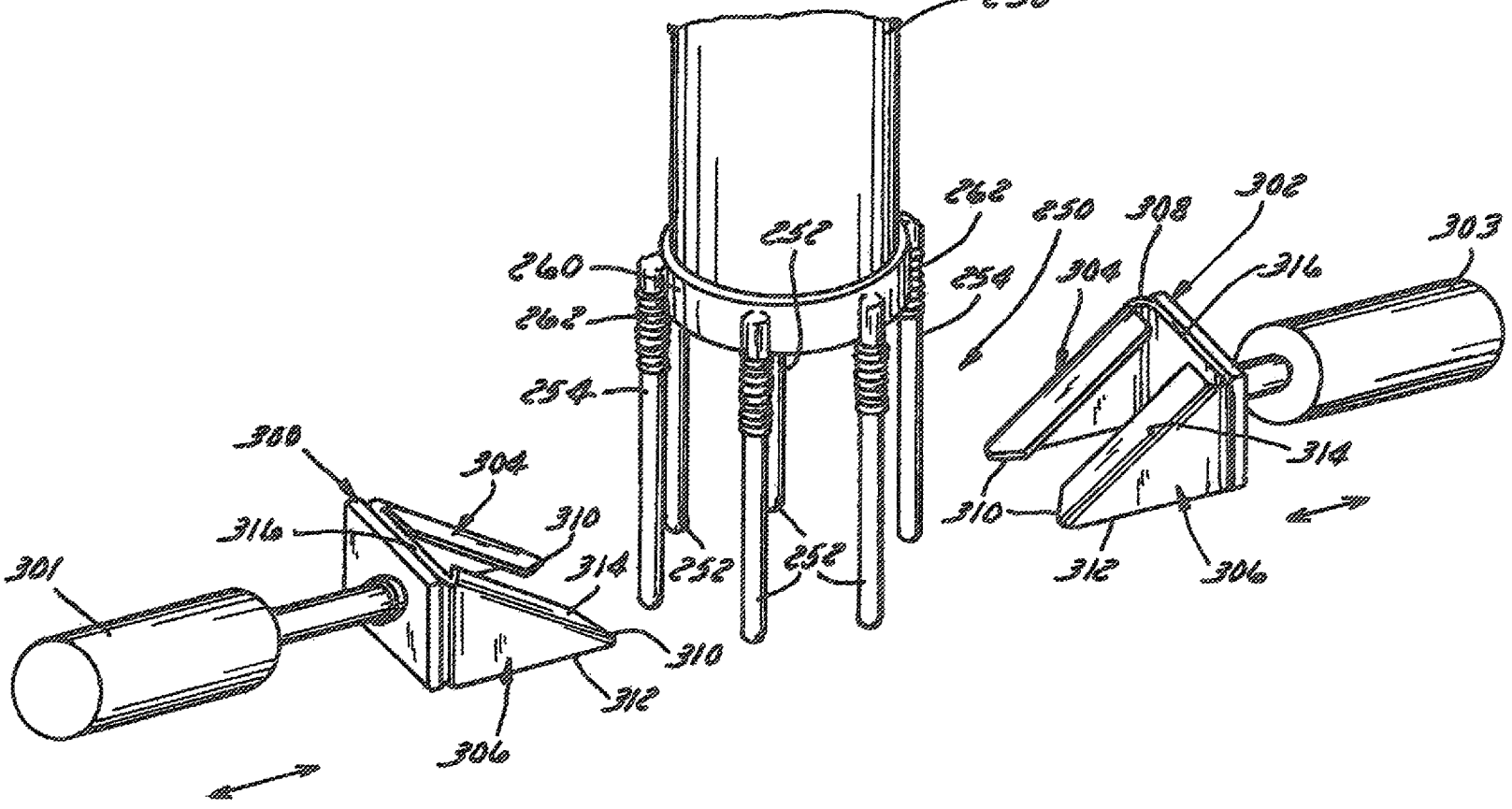
FIG. 11 is a fragmentary perspective view showing a bottom of the forming tube and the tuckers of the VFFS machine of FIG. 8, showing the tuckers in a retracted or non-operational position.
Figure 12:
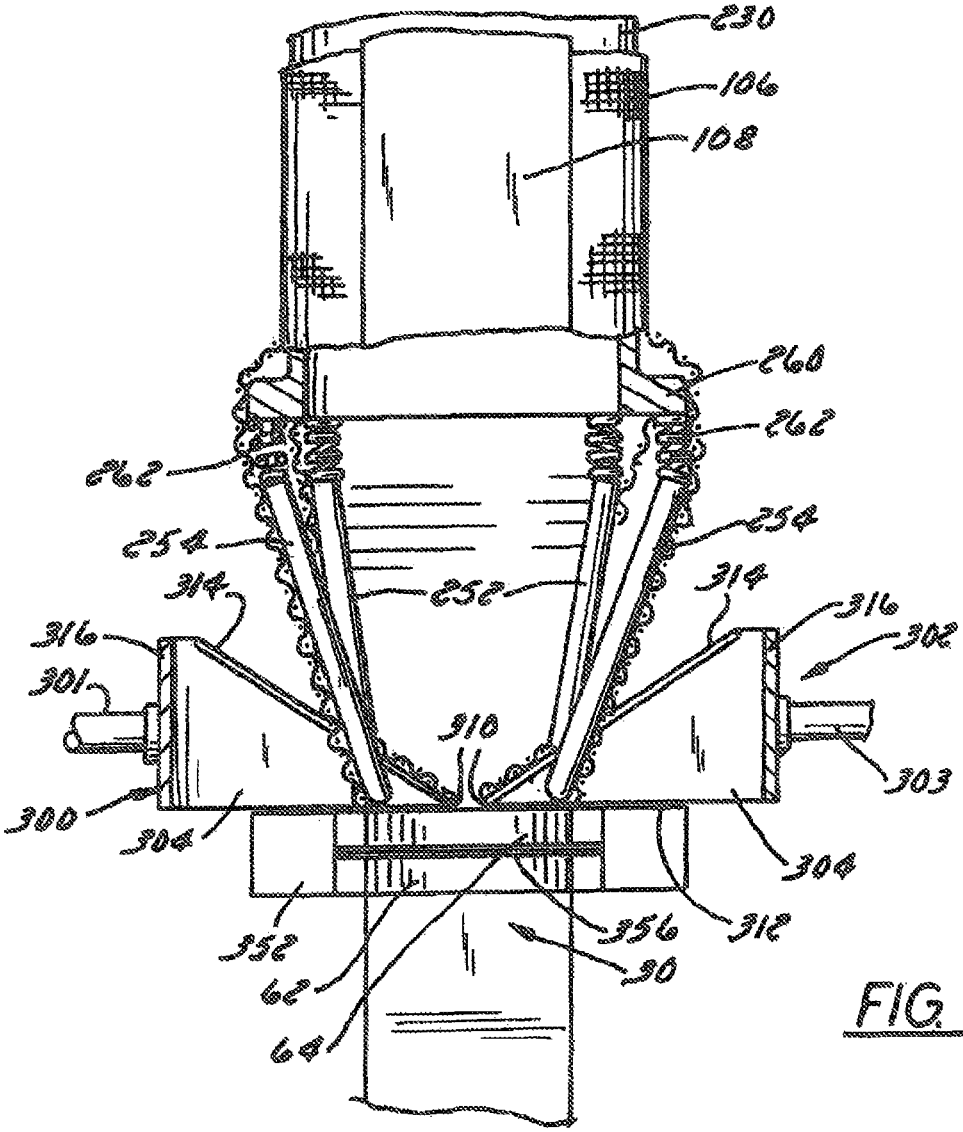
FIG. 12 is a front elevation view showing a bottom of the forming tube and the tuckers of the VFFS machine of FIG. 8, showing the tuckers in an extended or operational position.
Figure 13:
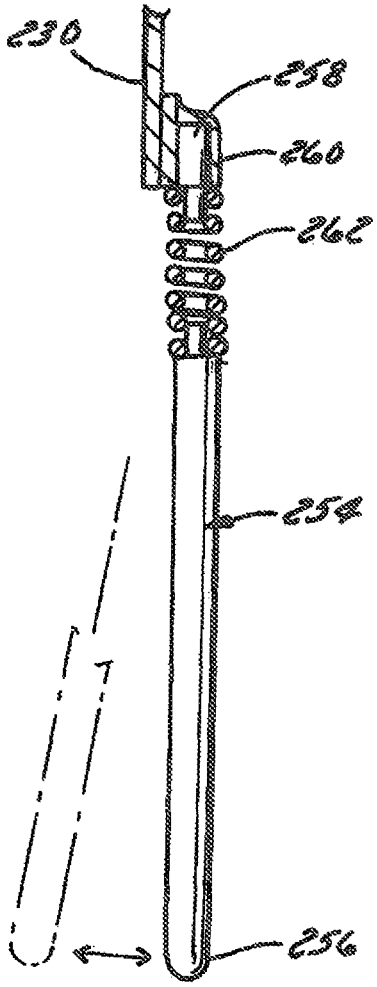
FIG. 13 is a side elevation view showing one of the guide pins of FIGS. 11 and 12 and the associated portion of the bottom of the forming tube.
Figure 14:
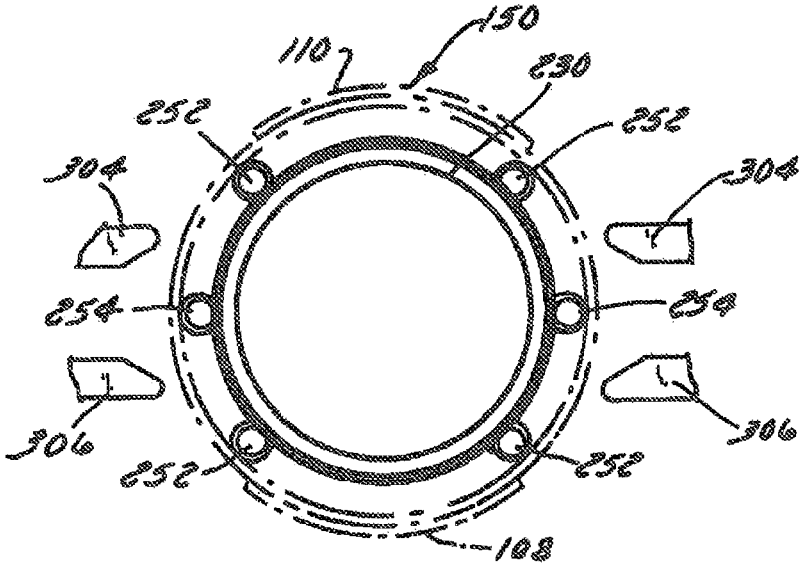
FIG. 14 is a somewhat schematic top plan view of the structures illustrated in FIGS. 11 and 12, showing the tuckers in a retracted position.

Referring now to FIGS. 11-15, a guide arrangement 250 is provided at the bottom of the forming tube 230 in order to impart the desired rectangular shape to the sleeve 150 as it is converted into a bag 20. In the illustrated embodiment, the guide arrangement takes the form of at least four, and preferably six, guide pins extending downwardly from the bottom end of the forming tube 230. Four of these guide pins are "corner" guide pins 252 that are provided at locations that correspond to the corners of the finished bag 20. These corner guide pins 252 support the sleeve 150 as it as it is drawn past the end of forming tube 230, thus forming the corners of the bag 20. Two additional "center" guide pins 254 may be provided at locations corresponding to the centers of the respective side walls 26 and 28 of the bag 20 in order to facilitate the gusseting operation performed by the tuckers 300, 302, described below. All of the guide pins 252, 254 may be formed from steel, another metal, or a plastic. Referring especially to FIG. 13, each guide pin 252, 254 has a tapered outer end 256 to prevent it from snagging on the sleeve 150 and has an inner end 258 that is welded to or otherwise affixed to a collar 260 mounted on the bottom end of and the forming tube 230.

At least the center guide pins 254, and preferably all of the guide pins 252 and 254, are constructed so as to resiliently deflect or pivot toward the center of the forming tube 230 when the tuckers 300, 302 are extended so as to avoid tearing the web 100 or otherwise damaging the sleeve 150. This deflection is best seen in FIGS. 12 and 13. The resilient deflection could be enabled simply by forming an end portion of the guide pin adjacent the inner end 258 in the form of a spring 262. Alternately, at least the inner end of the guide pin could be made of a relatively resilient material such as a resiliently flexible plastic.

The illustrated guide arrangement 250 also could be replaced by other structures such as bars so long as they achieve the desired result.

Referring especially to FIGS. 11 and 12, left and right gusseting blades or tuckers 300, 302 are provided beneath the discharge opening in the forming tube 230 immediately above the sealing and cutting assembly 350 (described below) and in vertical alignment with the guide pins 254. The tuckers 300, 302 are driven by actuators such as pneumatic cylinders 301 and 303 to fold the center of the left and right side walls 26 and 28 of the bag 20 between the edges of the front and rear walls 22 and 24, thus forming the afore-mentioned gussets 56, 58 in the side walls 26 and 28 of the bag 20. The depth of the gussets 56, 58 is determined by the stroke of the tuckers 300, 302 and, as discussed above, approaches the center of the bag 20 without overlapping it in the illustrated embodiment.

Figure 15:
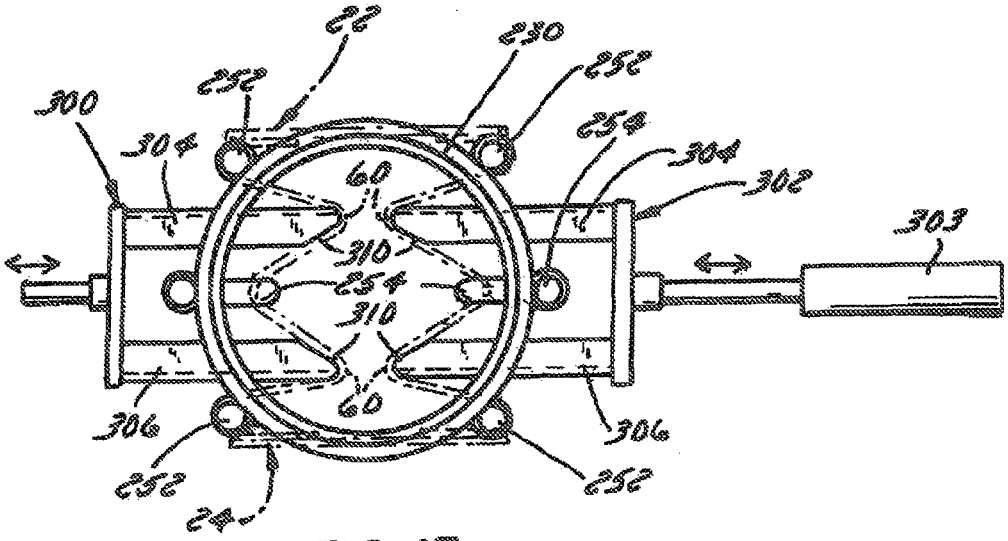
FIG. 15 is a somewhat schematic top plan view of the structures illustrated in FIGS. 11 and 12, showing the tuckers in an extended position.

Referring particularly to FIGS. 11, 12, and 15, each of the tuckers 300, 302 is generally in the shape of a sideways "n", having first and second spaced forming edges or blades 304 and 306. The blades 304 and 306 of each tucker are separated by a gap and are located on opposite sides of a respective one of the center guide pins 254. Each blade 304, 306 has an inner end 308, an outer forming end 310 that contacts the sleeve 150, a horizontal bottom edge 312, and an upper edge 314 that slopes downwardly from its inner end 308 to its other end 310. Both blades 304 and 306 may be bent or otherwise formed integrally with a rear support plate 316 that is attached to the associated pneumatic cylinder 301 or 303. Each tucker 300 or 302 may be formed of any of a number of rigid, durable materials such as steel.

Referring again to FIGS. 8 and 9, an end sealing and cutting assembly 350 is located beneath the guide arrangement 250 and the tuckers 300, 302. Assembly 350 includes a pair of opposed heated seal bars 352, 354 that are selectively movable toward each other to horizontally compress the sleeve 150 above the level of the product in the filled bag 20 to form a fin seal. The fin seal forms the lateral top seam 62 in the bag 20 containing the items and a lateral bottom seam 64 in the next bag 20 to be filled with the items. The combined seam 62, 64 is formed by heating the layers of the various materials so to bond front and rear walls 22 and 24 to each other and to the captured ends of the side walls 26 and 28, generally as seen in FIGS. 9 and 12. The seal bars 352 and 354 are moved into the operative position by pneumatic cylinders 356, 358 (FIG. 8) when the tuckers 300, 302 are in their operative position, assuring that the gussets 56, 58 of the side walls 26 and 28 of the bags 20 are securely retained between the front and rear walls 22 and 24 during the sealing process. Cylinders 356, 358 could be replaced by synchronized motors, cam-operated mechanisms, or any other devices capable of driving the tuckers 300 and 302 into and out of their operative positions, preferably but not necessarily in a synchronized manner. The assembly 350 also includes a retractable blade (not shown) that severs the filled and sealed bag 20 from the remainder of the sleeve 150 such that the filled and sealed bag 20 falls downwardly onto a slide 360 and is directed to a discharge conveyor 362, which carries the filled and sealed bag 20 away from VFFS machine 200.

In operation, the web 150, having been formed by the VFFS machine 200 or having been pre-formed, is pulled downwardly over the forming tube 230 from below by operation of the advancing belts 236 and 238. This movement occurs in discrete increments, with one bag 20 being formed in each increment. As the web 100 is advanced toward the forming tube 230, the forming shoulder 232 directs the web 100 around the forming tube 230 to form an initially circular tubular sleeve 150 in which the outer edge 104 of the first film strip 108 of the web 100 (FIGS. 6 and 11) overlaps the outer surface of the opposed edge of the mesh strip 106. As each increment of the sleeve 150 continues to index down the forming tube 230, the vertical sealing bar 234 heat bonds the overlapped edge of the first film strip 108 to the outer edge of the mesh strip 106. The sleeve 150 assumes the above-described rectangular shape is it is drawn past the bottom of the forming tube 230 and over the four corner guide pins 252. Between movement increments, the tuckers 300, 302 are advanced to form the gussets 56, 58 and are held in their advanced position while the seal bars 352 and 354 are advanced to form the bottom seam 64 in one bag 20 and the top seam 62 in the underlying bag 20. The newly formed bag 20 is filled at this time by dispensing items through the forming tube 230 from the product dispenser 210. The tuckers 300, 302 are then retracted, and the retractable blade is extended to separate the bag 20 from the underlying bag. The thus separated bag 20 then is directed down the slide 360 and to the discharge conveyor 362. At the same time, the advancing belts 236 and 238 are operated to index the next section of sleeve 150 downwardly over the guide pins 252 and 254, and the process is repeated.

Many changes and modifications could be made to the substrates, web, bags, and production systems and processes disclosed herein without departing from the spirit of the present invention. To the extent that they might not be apparent from the above, the scope of these variations will become apparent from the appended claims.

What is claimed is:

1. A method of forming a bag comprising, (A) moving a web downwardly over a forming tube of a vertical form, fill, and seal (VFFS) machine, the web comprising a continuous strip of open mesh material having first and second edges and a continuous strip of film material having first and second edges, the film material having a first edge bonded to the first edge of the open mesh material;

(B) bonding the second edge of the film material to the second edge of the open mesh material, thereby forming a tubular sleeve;

(C) shaping the sleeve into a generally rectangular form having first and second side walls formed of the open mesh material, a front wall, and a rear wall, one of which is formed at least in substantial part from the film material, the first and second side walls being gusseted as a result of the shaping step such that each of the first and second side walls has first and second longitudinally spaced gussets on opposite sides of a lateral bisector of a horizontal area containing a bottom surface of the bag, wherein the shaping step comprises guiding the sleeve past guides located beneath a bottom end of the forming tube, the guides including 1) first through fourth corner guides forming four corners of the bag and 2) fifth and sixth guides, each of which is disposed between two corner guides on a respective side of the sleeve, and engaging the first and second side walls of the sleeve with tuckers to form the gussets;

(D) moving the sleeve beneath a bottom end of the forming tube; and (E) bonding the front and rear walls together at a bottom of the sleeve with the first and second side walls captured therebetween, thereby forming a bag having a closed bottom end, wherein the bag has a depth to width ratio of at least 1.5:1 at the bottom of the bag.

2. The method of claim 1, further comprising, after the bonding step, filling the bag with items, wherein, as a result of the filling step, the first and second side walls are expanded; and after the filling step, bonding the front and rear walls together at a location above the items with the first and second side walls captured therebetween, thereby forming a closed top end of the bag and a closed bottom end of an adjacent bag.

3. The method of claim 2, wherein the film material is formed from a first strip of film material, and wherein the web further comprises a second strip of film material bonded to an exterior surface of the open mesh material between the first strip of film material and the second edge of the open mesh material, and wherein one of the front and rear walls of the bag is formed at least in substantial part from the first strip of film material and the other of the front and rear walls of the bag is formed at least in substantial part from the open mesh material, overlaid by the second strip of film material.

4. The method of claim 1, wherein the guiding step additionally comprises guiding the sleeve past fifth and sixth guide pins, each of which is disposed beneath the bottom end of the forming tube at a location adjacent a center of the respective one of the first and second side walls, respectively, wherein each of the tuckers is generally in the shape of a sideways "n", having first and second spaced forming edges separated by a gap and located on opposite sides of a respective one of the fifth and sixth guide pins, and wherein the engaging step comprises engaging each of the first and second side walls of the sleeve with the first and second forming edges of the respective tucker, thereby forming two gussets in each of the first and second side walls of the sleeve located on opposite sides of the respective one of the fifth and sixth guide pins.

5. The method of claim 4, wherein each of the fifth and sixth guide pins resiliently deflects during the forming step.

6. The method of claim 1, wherein the hag has a depth to width ratio of at least 1.75:1 at the bottom of the bag.

7. The method of claim 1, wherein, at the bottom of the bag, each of the gussets has an apex that closely approaches but does not overlap a line that longitudinally bisects the horizontal area containing the bottom surface of the bag.

8. The method of claim 1, wherein, at the bottom of the bag, each of the gussets has an apex that is spaced no more than 25% of the width of the front wall of the bag from a line that longitudinally bisects the horizontal area containing the bottom surface of the hag.

9. The method of claim 1, wherein the shaping step comprises guiding the sleeve past guides located beneath a bottom end of the forming tube, the guides including 1) first through fourth corner guides forming corners of the bag and 2) fifth and sixth guides, each of which is disposed between two corner guides on a respective side of the sleeve;

engaging the first and second sides of the sleeve with first and second tuckers to form the gussets, each of the tuckers including first and second spaced portions that engage an associated side of the sleeve on opposite sides of an associated one of the fifth and sixth guides.

10. The method of claim 9, wherein each of the first through sixth guides comprises a guide pin.

11. The method of claim 9, wherein each of the fifth and sixth guides resiliently deflects during the forming step.

12. A method of forming a bag comprising:

(A) moving a web downwardly over a forming tube of a vertical form, fill, and seal (VFFS) machine, the web comprising a continuous strip of open mesh material having first and second edges and a continuous strip of film material having first and second edges, the film material having a first edge bonded to the first edge of the open mesh material;

(B) bonding the second edge of the film material to the second edge of the open mesh material, thereby forming a tubular sleeve;

(C) shaping the sleeve into a generally rectangular form having first and second side walls formed of the open mesh material, a front wall, and a rear wall, one of which is formed at least in substantial part from the film material, the first and second side walls being gusseted as a result of the shaping step with two spaced gussets formed in each of the first and second side walls on opposite sides of a lateral bisector of a horizontal plane containing a bottom surface of the bag, wherein the shaping step comprises guiding the sleeve past guides located beneath a bottom end of the forming tube, the guides including 1) first through fourth corner guides forming corners of the bag and 2) fifth and sixth guides, each of which is disposed between two corner guides on a respective side of the sleeve, and engaging the first and second side walls of the sleeve with first and second tuckers to form the gussets, each of the tuckers including first and second spaced portions that engage an associated side of the sleeve on opposite sides of an associated one of the fifth and sixth guides;

(D) moving the sleeve beneath a bottom end of the forming tube; and (E) bonding the front and rear walls together at the bottom of the sleeve with the first and second side walls captured therebetween, thereby forming a bag having a closed bottom end, each of the first and second side walls having first and second longitudinally spaced gussets on opposite sides of a lateral bisector of a horizontal area containing a bottom surface of the bag, wherein each of the gussets has an apex that approaches but does not overlap a longitudinal bisector of the horizontal area.

13. A method of forming a bag comprising, (A) moving a web downwardly over a forming tube of a vertical form, fill, and seal (VFFS) machine, the web comprising a continuous strip of open mesh material and having first and second edges;

(B) bonding the second edge of the web to the first edge of the web, thereby forming a tubular sleeve;

(C) shaping the sleeve into a generally rectangular form having first and second side walls formed of the open mesh material, a front wall, and a rear wall, the first and second side walls being gusseted as a result of the shaping step such that each of the first and second side walls has first and second longitudinally spaced gussets on opposite sides of a lateral bisector of a horizontal area containing a bottom surface of the bag, wherein the shaping step comprises guiding the sleeve past guides located beneath a bottom end of the forming tube, the guides including 1) first through fourth corner guides forming corners of the bag and 2) fifth and sixth guides, each of which is disposed between two corner guides on a respective side of the sleeve, and engaging the first and second side walls of the sleeve with tuckers to form the gussets;

(D) moving the sleeve beneath a bottom end of the forming tube; and (E) bonding the front and rear walls together at a bottom of the sleeve with the first and second side walls captured therebetween, thereby forming a bag having a closed bottom end.

14. The method of claim 13, wherein strip of mesh material has a first edge forming the first edge of the web and has a second edge, and wherein the web further comprises a continuous strip of film material having a first edge bonded to the second edge of the strip of mesh material and having a second edge forming the second edge of the web.

15. The method of claim 13, wherein the shaping step comprises guiding the sleeve past guides located beneath a bottom end of the forming tube, the guides including 1) first through fourth corner guides forming corners of the bag and 2) fifth and sixth guides, each of which is disposed between two corner guides on a respective side of the sleeve;

engaging the first and second side walls of the sleeve with first and second tuckers to form the gussets, each of the tuckers including first and second spaced portions that engage the associated side of the sleeve on opposite sides of the associated one of the fifth and sixth guides.

* * * * *